US005762469A

United States Patent [19]

Yu

[11] Patent Number: 5,762,469

[45] Date of Patent: Jun. 9, 1998

[54] IMPELLER FOR A REGENERATIVE TURBINE FUEL PUMP

[75] Inventor: Dequan Yu, Ann Arbor, Mich.

[73] Assignee: Ford Motor Company, Dearborn, Mich.

[21] Appl. No.: 880,140

[22] Filed: Jun. 20, 1997

Related U.S. Application Data

[63] Continuation of Ser. No. 732,193, Oct. 16, 1996, abandoned.

[51] Int. Cl.[6] ..... F04D 29/42

[52] U.S. Cl. ..... 415/55.1

[58] Field of Search ..... 415/55.1–55.5

[56] References Cited

U.S. PATENT DOCUMENTS

| | | |
|---|---|---|
| 1,689,579 | 8/1928 | Burks . |
| 2,042,499 | 9/1936 | Brady . |
| 2,283,844 | 4/1942 | Brady, jr. . |
| 3,359,908 | 12/1967 | Toma . |
| 5,498,125 | 3/1996 | Hablanian . |
| 5,513,950 | 5/1996 | Yu . |

*Primary Examiner*—John T. Kwon
*Attorney, Agent, or Firm*—Neil P. Ferraro

[57] ABSTRACT

An impeller for use in a regenerative pump for pumping automotive fuel to an engine includes a plurality of vanes radially extending from a core. Each vane has a leading surface, a trailing surface, and a sidewall between the leading surface and the trailing surface. A plurality of partitions is interposed between the vanes such that the vanes and partitions define a plurality of vane grooves. Fuel is then pumped by the vanes through the vane grooves such that the fuel flows along a generally spiral path thereby defining a primary vortex. A relief is formed at least partially along the length of each vane at the intersection between the trailing surface and the sidewall. This relief causes the fuel flowing along the generally spiral path, also known as the primary vortex, to also rotate about an instantaneous axis thereby defining a secondary vortex. The secondary vortex has the benefit of reducing turbulence with the attendant benefit of reducing cavitation or vapor generation within the fuel pump.

14 Claims, 3 Drawing Sheets

IMPELLER FOR A REGENERATIVE TURBINE FUEL PUMP

This is a continuation of application Ser. No. 08/732,193 filed Oct. 16, 1996, abandoned.

FIELD OF THE INVENTION

This invention relates to regenerative turbine pumps for automotive fuel delivery systems and, in particular, to impellers for use in regenerative pumps.

BACKGROUND OF THE INVENTION

Conventional tank-mounted automotive fuel pumps typically have a rotary pumping element, such as an impeller, encased within a pump housing. Fuel flows into a pumping chamber within the pump housing and the rotary pumping action of the vanes and the vane grooves of the impeller cause the fuel to exit the housing at a higher pressure. Regenerative turbine fuel pumps are commonly used to pump fuel to automotive engines because they have a higher and more constant discharge pressure than, for example, positive displacement pumps. In addition, regenerative turbine pumps typically cost less and generate less audible noise during operation.

Certain disadvantages with prior art regenerative turbine fuel pumps exist. For example, it has been found that a large amount of turbulence is generated due to the tortuous fuel path in the fuel pump housing that the fuel must travel. This increased turbulence not only reduces the efficiency of the fuel pump but also causes cavitation or fuel vapor generation in the fuel pump housing. Vapor produced in the fuel pump housing must be effectively managed so that the fuel pump can operate at high efficiency. Prior art pumps generally have ports to evacuate such vapor; however, none has been effective in reducing the amount of vapor generated.

The inventor of the present invention has discovered that fuel flow in the fuel pump housing having a secondary vortex spinning about the instantaneous axis of the primary vortex formed by the regenerative turbine pump is desirable to reduce fuel flow turbulence and deviation of the fuel flow's intended flow path in much the same way that a rifle bullet or a football spinning about its axis as it moves through the air has less frictional drag and therefor less turbulence and is less likely to deviate from its intended flow path. In addition, as the fuel flows from the low pressure side of the pump housing to the high pressure side of the pump housing, the fuel flow slows due to the high backpressure associated therewith. By providing the secondary vortex spinning about the primary vortex, the fluid flow through the high pressure region is enhanced, and therefore the efficiency of the pump is improved and resulting in less energy consumption.

SUMMARY OF THE INVENTION

An object of the present invention is to reduce turbulence generated in the fuel pump housing thereby reducing vapor generation and improving fuel pump efficiency.

This object is achieved and disadvantages of prior art approaches are overcome by providing a novel impeller for use in a regenerative pump. The impeller includes a core having an axis of rotation and a plurality of vanes radially extending from the core. Each vane has a leading surface, a trailing surface, and a sidewall between the leading surface and the trailing surface. A plurality of partitions is interposed between the vanes such that the vanes and partitions define a plurality of vane grooves. Fluid is pumped by the vanes through the vane grooves such that the fluid flows along a generally spiral path to define a primary vortex. A relief extends at least partially along the length of each vane at the intersection between the trailing surface and the sidewall. The relief causes the fluid flowing along the generally spiral path to also rotate about an instantaneous axis of the generally spiral path to define a secondary vortex. In a preferred embodiment, the relief can either be a chamfer or a radius.

Accordingly, an advantage of the present invention is that the efficiency of the fuel pump is improved.

Another advantage of the present invention is that less turbulence is created, and therefore less fuel vapor is generated.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
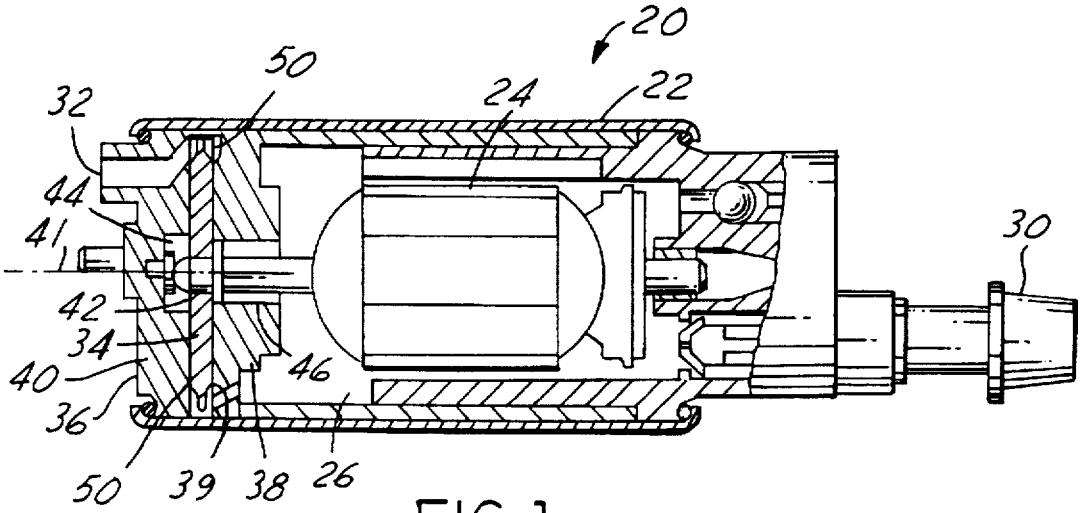
FIG. 1 is a cross-sectional view of a fuel pump according to the present invention.

Referring now to FIG. 1, fuel pump 20 has housing 22 for containing motor 24, preferably an electric motor, which is mounted within motor space 26. Motor 24 has shaft 28 extending therefrom in a direction from fuel pump outlet 30 to fuel inlet 32. Impeller 34 is slidingly engaged onto shaft 28 and is encased within pump housing 36, which is composed of pump bottom 38 and pump cover 40. Impeller 34 has a central axis 41 which is coincident with the axis of shaft 28. Shaft 28 passes through shaft opening 42 of impeller 34 and into cover recess 44 of pump cover 40. As seen in FIG. 1, shaft 28 is journalled within bearing 46. Pump bottom 38 has fuel outlet 39 leading from pumping chamber 50 formed along the periphery of impeller 34. In operation, fuel is drawn from a fuel tank (not shown), in which fuel pump 20 may be mounted, through fuel inlet 32 and pump cover 40 and into pumping chamber 50 by the rotary pumping action of impeller 34. High pressure fuel is then discharged through high pressure outlet 39 to motor space 26 and cools motor 24 while passing over it to fuel pump outlet 30.

Figure 4:
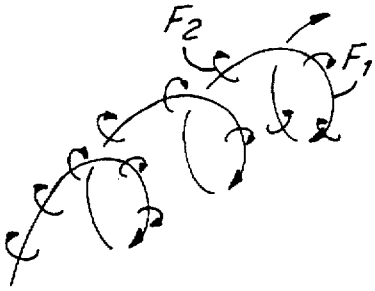
FIG. 4 is a diagrammatic representation of the fuel flow pumped by the impeller according to the present invention.
Figure 2:
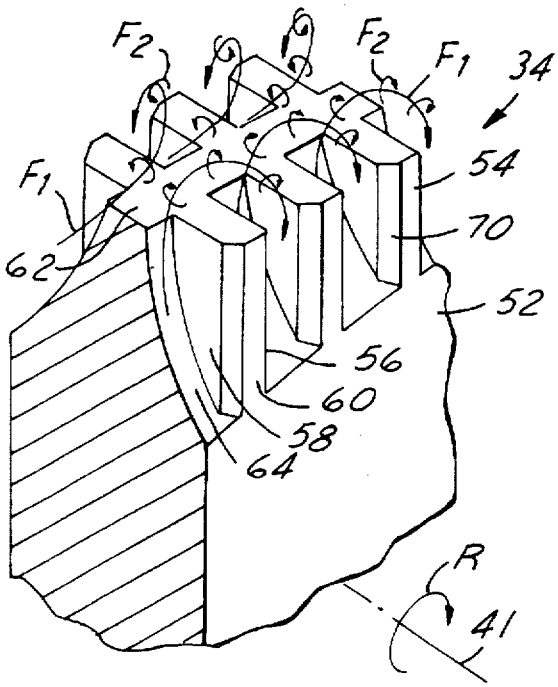
FIG. 2 is a diagrammatic perspective view of an impeller for use in the fuel pump according to the present invention.
Figure 3:
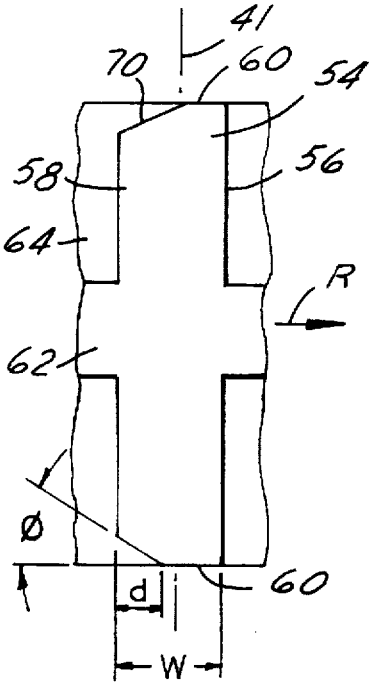
FIG. 3 is a top view of a vane of the impeller according to the present invention.

Turning now to FIGS. 2 and 3, impeller 34, according to the present invention, is shown. Impeller 34 may be formed of a plastic material, such as molded from phenolic, acetyl or other plastic which may or may not be glass filled, or of a non-plastic material known to those skilled in the art and suggested by this disclosure, such as diecast aluminum or steel. Impeller 34 includes core 52 and a plurality of vanes 54 radially extending from core 52. Each vane 54 has a leading surface 56, a trailing surface 58, and a sidewall 60 between leading surface 56 and trailing surface 58. Partition 62 is interposed between vanes 54 so as to define a plurality of vane grooves 64. As impeller 34 rotates in the direction shown by arrow "R", fuel is pumped by vane 54 through vane grooves 64 such that the fuel flows along a generally spiral path defining a primary vortex, shown as "$F_1$" in FIGS. 2 and 4.

According to the present invention, a relief, shown as chamfer 70 in FIGS. 2 and 3, extends at least partially along the length of each vane 54 between the trailing surface 58 and the sidewall 60. As impeller 34 rotates about axis 42 in direction "R", the relief causes the fuel flowing along the generally spiral path "$F_1$" (primary vortex) to also rotate about its instantaneous axis, thereby defining a secondary vortex "$F_2$"(see FIGS. 2 and 4). Thus, as fuel flows from the low pressure fuel inlet 32 (FIG. 1) to the high pressure fuel outlet 39, fuel flows along a generally spiral path "$F_1$" (primary vortex), while at the same time rotates about its own axis "$F_2$" (secondary vortex).

In a preferred embodiment, the angle of chamfer 70, shown as angle θ in FIG. 3, is between about 5° and about 30° relative to sidewall 60. The desired chamfer angle θ is about 15°. Also according to the present invention, the chamfer extends a distance "d" along sidewall 60 as measured from trailing surface 58 of about 0.1 mm to about 0.6 mm, when the width "w" of sidewall 60 is about 0.6 mm, with the desired distance being about 0.3 mm.

Figure 5:
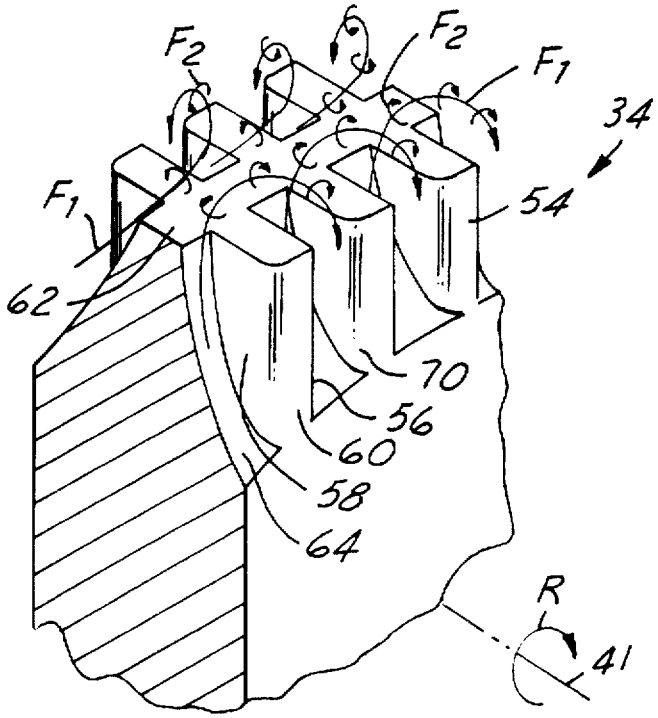
FIGS. 5 and 6 are alternative embodiments of the impeller and the impeller vanes of FIGS. 2 and 4, respectively.
Figure 6:
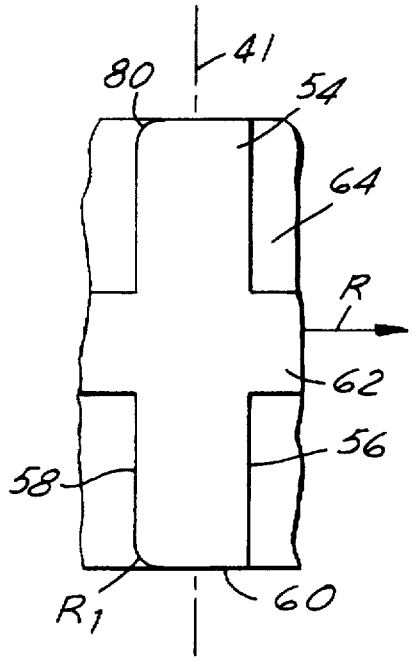

Referring now to FIGS. 5 and 6, where like elements will be described with like reference numerals, an alternative embodiment of impeller 34 is shown wherein the relief between trailing surface 58 and sidewall 60 of each vane 54 is formed with radius 80 rather than chamfer 70. In a preferred embodiment, radius 80 has a radius "$R_1$" between about 0.1 mm and about 0.6 mm, when the width "w" of sidewall 60 is about 0.6 mm, with the desired radius being about 0.3 mm. Thus, as fuel flows from low pressure fuel inlet 32 to the high pressure fuel outlet 39, the fuel flows along a generally spiral path "$F_1$" (primary vortex), while at the same time rotates about its instantaneous axis "$F_2$" (secondary vortex).

It should be noted that the relief, whether it be in the form of chamfer 70 or radius 80, must not be too large or too small. That is, the relief should not extend into trailing surface 58 beyond a predetermined amount (the amount defined by angle θ of chamfer 70 or radius "$R_1$" of radius 80). If the relief extends to far into trailing surface 58, the secondary vortex "$F_2$" will break up and therefore defeat the intended purpose of reducing turbulence generated in the pump housing. Similarly, if no relief is provided, there can be no generation of the second vortex "$F_2$".

Figure 7:
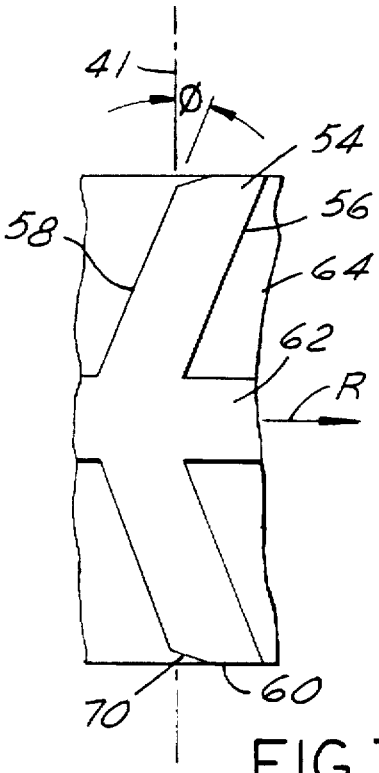
FIGS. 7 and 8 are top plan views of alternative embodiments of the impeller vanes according to the present invention; and, FIGS. 9–11 are side views of alternative embodiments of the impeller according to the present invention.
Figure 8:
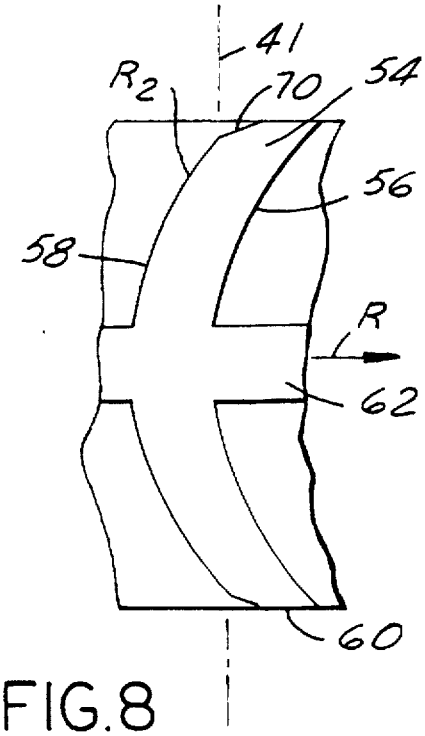

Referring now to FIGS. 7 and 8, vanes 54 are laterally inclined toward the rotational direction "R" of impeller 34. This has the added benefit of producing a stronger secondary vortex than when vanes 54 are not laterally inclined, as shown in FIGS. 1–5. In FIG. 7, the leading and trailing surfaces 56, 58 of laterally inclined vanes 54 are flat, as shown, but are inclined at an angle, ø, relative to axis 41. Angle ø is preferably between about 0° and about 60°, with 30° being the preferred angle of inclination ø. In FIG. 8, the leading and trailing surfaces 56, 58 of laterally inclined vanes 54 are curved along a compound curve such that trailing surface 58 is generally convex and leading surface 56 is generally concave. In a preferred embodiment, the radius of curvature "$R_2$" is about 1.15 mm at the end of the vane closest to partition 62, with the laterally outer portions of surfaces 56 and 58 adjacent sidewall 60 extending along a line tangent to radius "$R_2$". This compound curve of vanes 54 also makes the secondary vortex stronger when compared to the flat vanes of FIGS. 1–7. As shown in FIGS. 7 and 8, the relief is formed with chamfer 70. However, as discussed with reference to FIGS. 5 and 6, the relief may be formed with radius 80.

Figure 9:
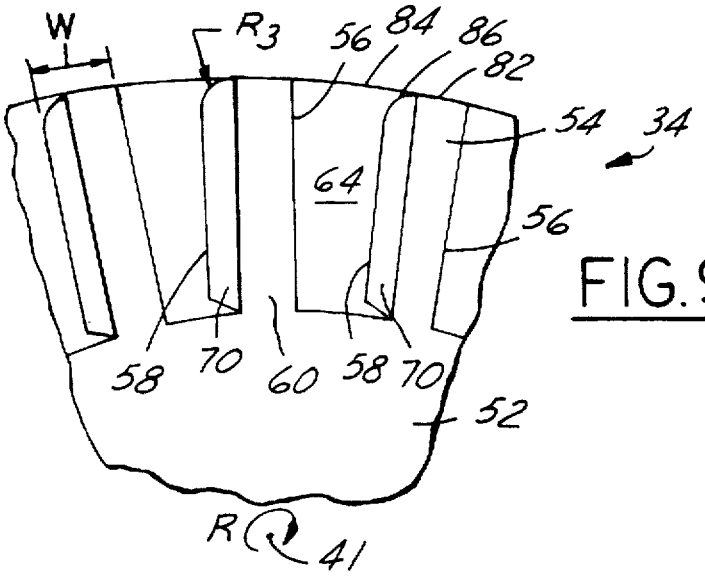
Figure 10:
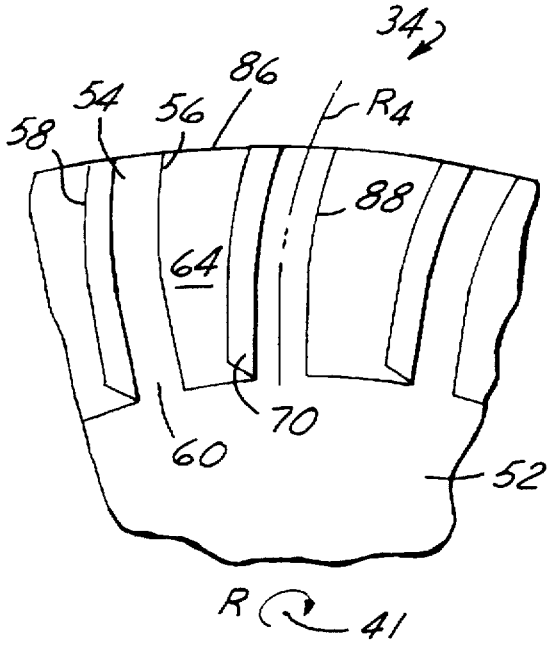
Figure 11:
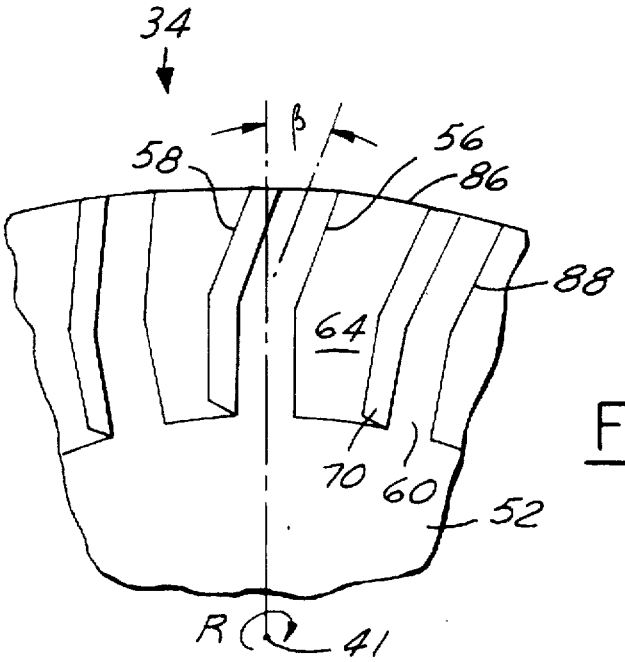

Referring now to FIGS. 9–11, a side view of impeller 34 is shown. In FIG. 9, outer edge 82 of impeller vanes 54 define outer circumference 84 of impeller 34. In addition, radius 86 is formed at the intersection between trailing surface 58 and outer edge 82. This radius 86 helps to smooth the leading portion of the fuel flow as it moves from the low pressure region to the high pressure region throughout vane grooves 64. In a preferred embodiment, the radius 86 has a radius "$R_3$" of about 0.1 mm to about 0.6 mm, when the width "w" of outer edge 82 is about 0.6 mm, with the desired radius "$R_2$" being about 0.3 mm.

Turning now to FIGS. 10 and 11, outer portion 88 of vanes 54 are radially inclined toward the rotational direction "R" of impeller 34. This radial inclination increases the pumping pressure from about 500 kpa to about 600 kpa without a corresponding increase in the current draw on electric motor 24 of pump 20. In FIG. 10, radially outer portion 88 of vanes 54 is curved such that leading surface 56 is generally concave and trailing surface 58 is generally convex. In a preferred embodiment, the radius of curvature, shown as "$R_4$" is about 8 mm. In FIG. 11, the radially outer portion 88 of vanes 56 is flat, as shown, but is inclined at an angle β relative to a line passing through axis of rotation 41 between about 0° and about 15°, with 10° being the desired angle of inclination β.

While the best mode for carrying out the invention has been described in detail, those skilled in the art to which this invention relates will recognize various alternative designs and embodiments, including those mentioned above, in practicing the invention that has been defined by the following claims.

I claim:

1. An open vane type impeller for use in a regenerative pump for pumping fluids, the pump having a pump housing including a pumping chamber, with said impeller being adapted to cooperate with the pumping chamber for pumping fluids therethrough, with said impeller comprising:

a core having an axis of rotation;

a plurality of vanes radially extending from said core, with each said vane having an outer edge defining an outer circumference of said impeller, with said outer circumference being adapted to cooperate with the pumping chamber so as to allow fluid communication between opposite sides of the impeller, with said fluid communication occurring outside said outer circumference thereby defining the open vane type impeller, with each said vane having a leading surface, a trailing surface and a sidewall between said leading surface and said trailing surface, with said outer edge intersecting said trailing surface at a substantially right angle;

a plurality of partitions interposed between said vanes such that said vanes and partitions define a plurality of vane grooves, with said fluid being pumped by said vanes through said vane grooves such that said fluid flows along a generally spiral path within the pumping chamber thereby defining a primary vortex; and, a substantially constant width relief extending along the entire length of each said vane between said core and said outer edge and being connected between said trailing surface and said sidewall, with said relief extending between said sidewall and said trailing surface and intersecting said sidewall at a distance of about 50% of the width of said sidewall as measured between said trailing surface and said leading surface;

wherein said relief causes said fluid flowing along said generally spiral path to also rotate about an instantaneous axis of said generally spiral path thereby defining a secondary vortex so as to reduce fluid turbulence.

2. An impeller according to claim 1 wherein said relief is a chamfer having an angle of about 15° relative to said sidewall.

3. An impeller according to claim 1 wherein said relief is a radius.

4. An impeller according to claim 1 wherein said vanes are laterally inclined toward the rotational direction of said impeller.

5. An impeller according to claim 4 wherein said laterally inclined vanes are flat but inclined at an angle relative to said axis of rotation between about 0° and about 60°.

6. An impeller according to claim 4 wherein said laterally inclined vanes are curved such that said trailing surface is generally convex and said leading surface is generally concave.

7. An impeller according to claim 1 further comprising a radius formed at the intersection between said trailing surface and said outer edge.

8. An impeller according to claim 1 wherein a radially outer portion of each said vane is radially inclined toward the rotational direction of said impeller.

9. An impeller according to claim 8 wherein said radially inclined vanes are flat but inclined at an angle relative to a line passing through said axis of rotation, with said angle being between about 0° and about 15°.

10. An impeller according to claim 8 wherein said radially inclined vanes are curved such that said radially outer portion of said leading surface is generally concave and said radially outer portion of said trailing surface is generally convex.

11. An impeller for use in a regenerative pump for pumping fluids comprising:

a core having an axis of rotation;

a plurality of vanes radially extending from said core, with each said vane having a leading surface, a trailing surface and a sidewall between said leading surface and said trailing surface;

a plurality of partitions interposed between said vanes such that said vanes and partitions define a plurality of vane grooves, with said fluid being pumped by said vanes through said vane grooves such that said fluid flows along a generally spiral path thereby defining a primary vortex; and, a substantially constant width relief extending along the entire length of each said vane between said core and said outer edge and being connected between said trailing surface and said sidewall, with said relief causing said fluid flowing along said generally spiral path to also rotate about an instantaneous axis of said generally spiral path thereby defining a secondary vortex so as to reduce fluid turbulence.

12. An impeller according to claim 11 wherein a radially outer portion of each said vane is radially inclined toward the rotational direction of said impeller and curved such that said radially outer portion of said leading surface is generally concave and said radially outer portion of said trailing surface is generally convex.

13. An impeller according to claim 11 further comprising a radius formed at the intersection between said trailing surface and said outer edge.

14. An impeller according to claim 11 wherein a radially outer portion of each said vane is radially inclined toward the rotational direction of said impeller, with said radially inclined vanes being flat but inclined at an angle relative to a line passing through said axis of rotation, with said angle being between about 0° and about 15°.

* * * * *